US006923621B2

(12) United States Patent
Sato

(10) Patent No.: US 6,923,621 B2
(45) Date of Patent: Aug. 2, 2005

(54) DIFFUSER FOR A TURBO PUMP

(75) Inventor: Hitoshi Sato, Higashimurayama (JP)

(73) Assignee: Nikkiso Co., Ltd., Tokyo (JP)

( * ) Notice: Subject to any disclaimer, the term of this patent is extended or adjusted under 35 U.S.C. 154(b) by 74 days.

(21) Appl. No.: 10/638,068

(22) Filed: Aug. 8, 2003

(65) Prior Publication Data

US 2004/0071545 A1 Apr. 15, 2004

(30) Foreign Application Priority Data

Oct. 9, 2002 (JP) ..... 2002-296320

(51) Int. Cl.[7] ..... F04D 29/44
(52) U.S. Cl. ..... 415/199.3; 415/199.2
(58) Field of Search ..... 415/148, 199.2, 415/199.3, 211.1, 211.2, 209.1

(56) References Cited

U.S. PATENT DOCUMENTS 5,178,516 A * 1/1993 Nakagawa et al. ..... 415/211.2
5,383,764 A * 1/1995 Ogawa et al. ..... 415/199.3

FOREIGN PATENT DOCUMENTS

| | | |
|---|---|---|
| JP | 04-143499 | 5/1992 |
| JP | 2735730 | 1/1998 |
| JP | 11-173296 | 6/1999 |
| JP | 2001-3897 | 1/2001 |

OTHER PUBLICATIONS

Patent Abstracts of Japan for JP06–026496 published on Feb. 1, 1994.
Patent Abstracts of Japan for JP11–173296 published on Jun. 29, 1999.
Patent Abstracts of Japan for JP04–143499 published on May 18, 1992.
Patent Abstracts of Japan for JP2001–3897 published on Jan. 9, 2001.

* cited by examiner

*Primary Examiner*—Edward K. Look
*Assistant Examiner*—Richard A. Edgar
(74) *Attorney, Agent, or Firm*—Darby & Darby

(57) ABSTRACT

To suppress degradation of the pump efficiency while preventing the diffuser from stalling on a turbo pump Opening 48 is provided at a specified position in the cord length direction of vane 42 of diffuser 44. Opening 48 communicates with the adjacent diffuser flow passage to form a flow circulating to the entrance of the diffuser via this opening 48 when the flow rate drops, thus to prevent stalling by increasing the apparent flow rate. The size of opening 48 is also adjusted in correspondence with the operating condition of said pump. The size of opening 48 should be adjusted to be small enough not to case stalling at the lowest flow rate expected by test operating the pump. The efficiency degradation due to the provision of the opening can be suppressed.

6 Claims, 3 Drawing Sheets

DIFFUSER FOR A TURBO PUMP

BACKGROUND OF THE INVENTION

1. Field of the Invention

The invention relates to a diffuser to be provided on the discharge side of a turbo pump, in particular, to the structure of the diffuser's vanes, and the method of manufacturing a diffuser with a structure having such vanes.

2. Description of the Related Art

A diffuser is sometimes provided on the discharge side of a turbo pump for efficiently converting the velocity energy generated by the impeller of the pump into pressure energy. A diffuser has a plurality of vanes that form multiple flow paths for reducing the velocity of the subject fluid discharged from the impeller and increase the pressure. The shape of a vane, i.e., the shape of the flow path, is determined based on the design point of the pump. As a result, when the pump is operating under conditions different from said design point, the flow of the fluid in the diffuser flow path is different from the flow under the design point and causes pump operation problems in some cases. When the flow rate reduces, in particular, the flow of the subject fluid peels off from the vane and causes a stall. This stall does not occur simultaneously in all flow paths but rather in some of the flow paths, or often only in one flow path. This distorts the symmetry of the fluid flow relative to the centerline of the pump and generates a radial force against the pump. Moreover, as time passes, the flow path where the stall occurs rotates around the axis of the pump, consequently causing the direction of said radial force acting on the pump to change and generating a vibration of the pump. Such a phenomenon that the area where the stall is occurring rotates around the axis of the pump is called a rotational stall.

A method of suppressing the abovementioned rotational stall is disclosed in Japanese Patent No. 2735730. The patent shows an embodiment where each vane of the diffuser consists of two parts separated by a gap along the direction of the flow of the fluid. As the discharge flow reduces, a circulating flow develops in which the fluid circulates back to the diffuser's inlet through the gap of the vane, thus causing the apparent flow rate to increase, suppressing the stall and the rotational stall.

When a diffuser's vane is divided into two parts separated in the direction of flow, it generates a circulating flow to suppress the stall, but it also causes a drop in the pump efficiency. Therefore, it has been customary to seek an optimum position of the gap and its width (space that separates the two parts of a vane), a compromise that provides a smaller pump efficiency drop and efficient stall suppression, by trial and error. However, once the position and width of a gap is formed by machining, it is difficult to change it later. Although the width can be changed, it means a further drop of the pump efficiency. As the occurrence of the rotational stall varies with the installation condition of the pump, said trial and error method of seeking an optimum position and width makes it necessary to produce multiple diffuser prototypes or may cause to reduce the pump efficiency unnecessarily.

The present invention is intended to solve these problems by conducting the adjustment for the rotational stall suppression more efficiently while minimizing the pump efficiency drop inevitably caused in the effort of the rotational stall suppression.

SUMMARY OF THE INVENTION

The diffuser of the turbo pump according to this invention has an opening having a length smaller than the width of the vane provided at a specified location in the cord direction of the vane to communicate the adjacent diffuser flow paths separated by the vane. This opening preferably has a groove shape cut on one end of the vane running in the width direction of the vane. The depth of this groove, i.e., the length of the opening, is adjustable in accordance with the installation condition of the pump.

Said diffuser can be manufactured by first forming a diffuser having a plurality of diffuser flow paths separated by vanes, and then forming on each vane an opening that communicates the adjacent diffuser flow paths by a metal cutting process at a specified location in the cord direction. More specifically, the opening can be formed by cutting it from one end of the vane in its width direction. The cross-sectional area of the opening can be determined based on the minimum flow rate which depends on the installation condition of the turbo pump.

DESCRIPTION OF THE PREFERRED EMBODIMENT

Figure 1:
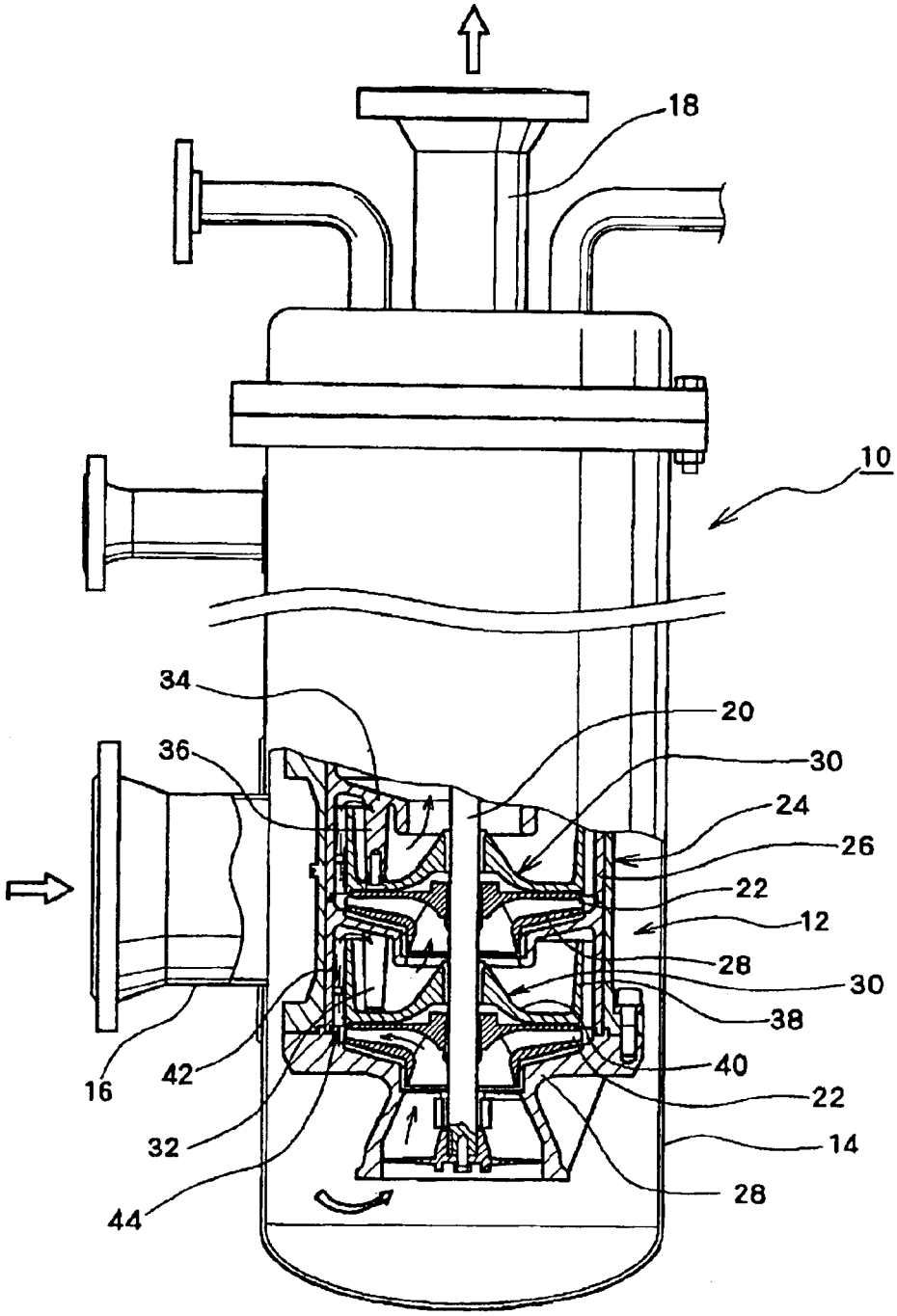
FIG. 1 is a view showing an outline constitution of an immersion type centrifugal pump according to an embodiment of the present invention.

FIG. 1 shows a cut-away view of an immersion type centrifugal pump 10, which is used by being totally immersed in the subject fluid, as an example of a turbo pump with a diffuser. A two-stage centrifugal pump 12 and an electric motor (not shown) that drives it are encased in a pot 14. Pot 14 is provided with a inlet pipe 16 through which flows in the subject fluid, into which immersion type centrifugal pump 10 is immersed, and pot 14 is filled with the subject fluid. A discharge pipe 18 is provided in the upper part of pot 14.

Two-stage centrifugal pump 12 includes a pump shaft 20, two impellers 22 affixed to it, and an outer casing 24 that encases them. Outer casing 24 consists of an outer cylinder 26 that has an inner diameter slightly larger than the outer diameter of impellers 22, and a front part 28 that extends from outer cylinder 26 inward along the impeller's front shroud. Two-stage centrifugal pump 12 has an inner casing 30 provided on the inside of outer casing 24. The inner casing is affixed, in the first stage of centrifugal pump 12, to a boss 32 provided on front part 28 of the outer casing of the second stage, while, in the second stage, to a boss 36 provided on a rear part 34 of the casing, with bolts. Inner casing 30 includes an inner cylinder 38 provided inside outer cylinder 26 of the outer casing with a space in between them, and a backplane part 40 provided along the backplane shroud of impeller 22.

A plurality of vanes 42 are arranged in the circumferential direction on the outer periphery of cylinder 38. The space between cylinder 38 and outer cylinder 26 together with said vanes 42 constitute a diffuser 44. The flow of the subject fluid inside diffuser 44 has almost no radial component so that this diffuser 44 serves as a so-called axial diffuser.

The initial stage of two-stage centrifugal pump 12 induces the subject fluid through the suction port facing the bottom of port 14, and discharges toward the outer periphery of impeller 22. The velocity of the discharged subject fluid is reduced and its pressure is increased by means of diffuser 44, and the fluid flows from the outlet of diffuser 44 radially inward toward the suction port of the second stage. A similar flow pattern exists in the second stage as well.

Figure 2:
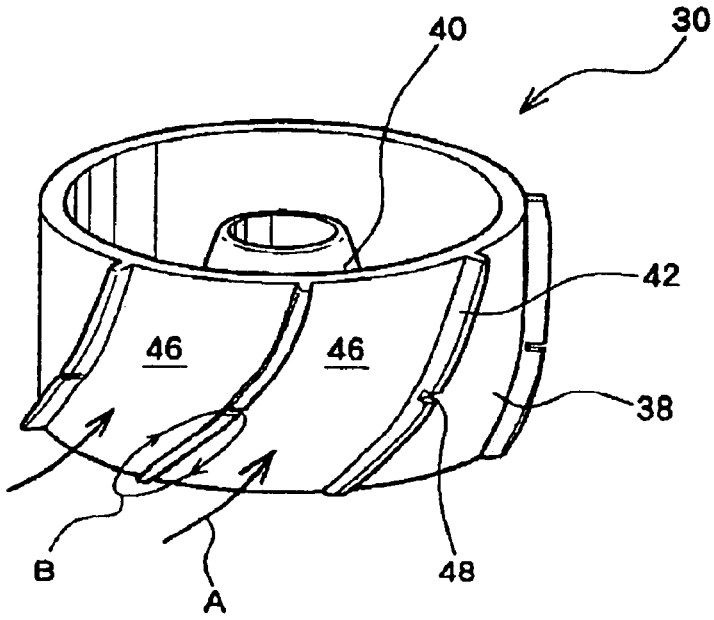
FIG. 2 is a perspective view showing an internal casing that constitutes the diffuser.

FIG. 2 is a perspective drawing of inner casing 30. As mentioned before, a plurality of vanes 42 are provided on the outer periphery of inner cylinder 38 of the inner casing. Vane 42 divides the cylindrical space between cylinder 38 and outer cylinder 26 provided on the outside in the circumferential direction, and each of these divided spaces serve as diffuser flow paths 46 where the subject fluid flows. In FIG. 2, the subject fluid flows from the bottom to the top as shown by an arrow A. A notch is formed at a specified location along the cord direction of vane 42 providing an opening 48 that communicates with adjacent diffuser flow paths 46.

If the actual flow rate of the pump is close to the design point, the fluid flows in the direction approximately along vanes 42, the flow peels off from vanes 42 and a stall occurs when the flow rate reduces. This stall occurs in a portion of diffuser 46, and moves to the next and to the next, causing a rotational stall. In case of the present embodiment, however, when the flow rate decreases, the subject fluid develops a circulating flow, as shown by an arrow B, that runs through opening 48 toward the diffuser's inlet side again, which then suppresses the stall by increasing the apparent flow rate within diffuser 44 to suppress the stall.

Figure 3:
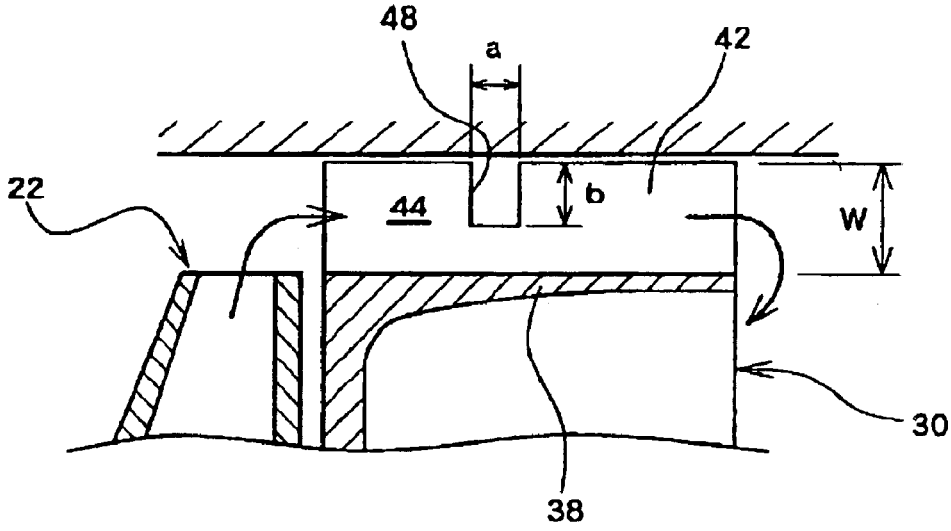
FIG. 3 is a cross-sectional view of the diffuser.

FIG. 3 is a cross-sectional view of diffuser 44. Vane 42 with a width (w) has an opening 48 at a specified location of the cord length direction (left-right direction in the drawing). The shape of opening 48 is approximately rectangular having a width (a) in the cord direction and a length (b) in the width direction of the vane. As shown in the drawing, opening 48 has a groove shape cut out from the edge of the outer periphery of vane 42 standing radially on cylinder 38 of the internal casing in the outward direction.

Figure 4:
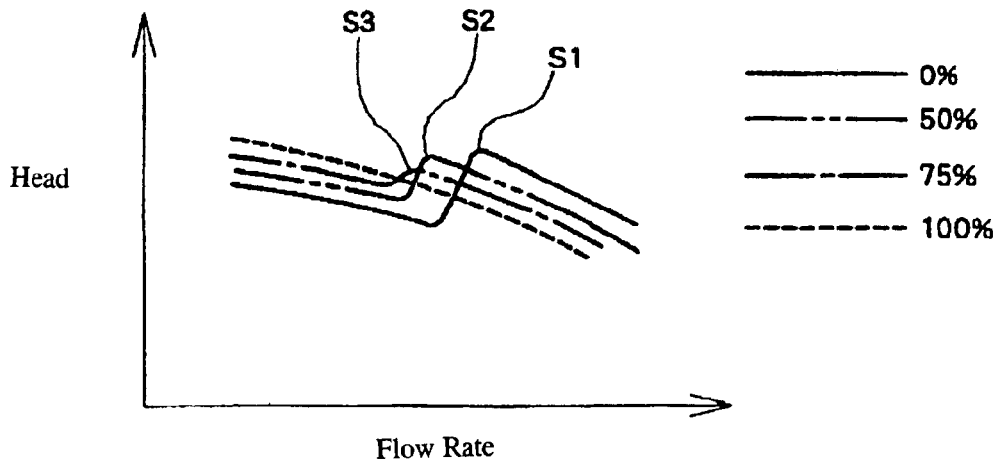
FIG. 4 is a graph showing the relations between the flow rate and the head for different ratios between the opening and the diffuser's vane.
Figure 5:
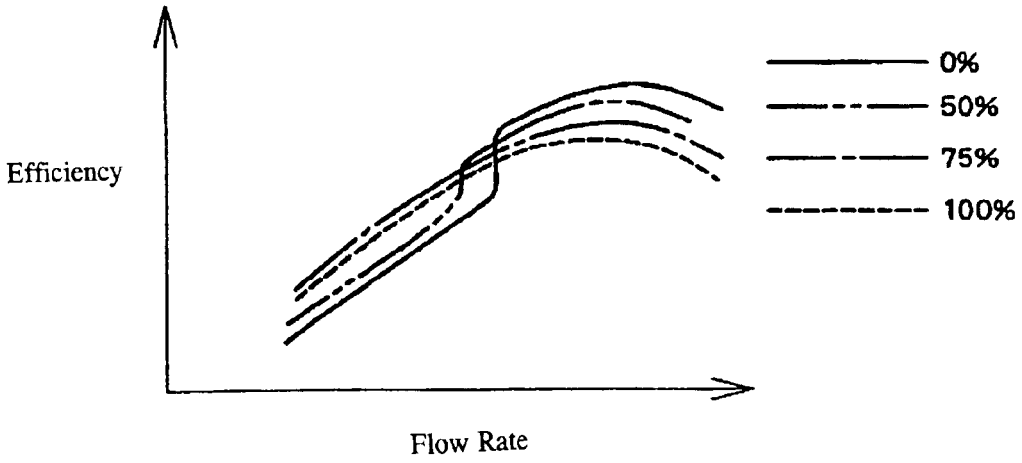
FIG. 5 is a graph showing the relations between the flow rate and the efficiency for different ratios between the opening and the diffuser's vane.

FIG. 4 and FIG. 5 are graphs showing the head and the efficiency relative to the flow rate for different length (b) of opening 48, i.e., the depth of the groove shape. In the graph, the length (b) of the opening relative to the width (w) of the vane is chosen as 0% (no opening), 50%, 75% and 100%, for each which the head and the efficiency relative to the flow rate is shown. As shown in FIG. 4, a stall occurs at a point S1 as the flow rate reduces when there is no opening (0%), and the head starts to reduce at this point. As can be seen from the graphs, the stall start point moves to S2 and then to S3, i.e., toward the low flow rate side, as the length (b) of the opening is increased. At 100%, no stalls occur practically speaking. On the other hand, when an opening is provided, the head reduces compared to the case of no opening and the efficiency also drops as shown in FIG. 5 in the region where the flow rate is higher than the threshold flow rate where the stall occurs. In other words, the stall can be prevented by providing an opening, but it causes the efficiency to drop. In this embodiment, the length (b) of the opening is chosen to be within a certain range so that it does not cause a stall but also minimizes the head and efficiency deteriorations in the normal operating range. In other words, opening 48 has a length shorter than the width (w) of vane 42. The length (b) is determined by the installation and operating conditions of the particular immersion type centrifugal pump.

As to the size of opening 48, vanes 42 of diffuser 44 are first made without opening, and then installation and tests are conducted to determine the optimum size of the opening. The openings can be formed easily by means of machining from the outer periphery of the inner casing 30 using a lathe. It is also possible to provide a small opening when inner casing 30 is originally made and then gradually increase the size by machining based the results of the tests.

As can be seen from the above, by machining the opening little by little to adjust its size, it is possible to satisfy contradictory requirements of prevention of stall vs. keeping the head and the efficiency with a high degree of accuracy. It also provides a means of suppressing stall for an existing pump by means of providing openings.

What is claimed is:

1. A diffuser for a turbo pump, comprising:

a diffuser vane positioned on said diffuser, including a width and a cord direction, comprising:

an opening with a length shorter than said vane width, said opening is provided at a specified location in said vane cord direction, wherein said opening communicates adjacent diffuser flow paths divided by the vane.

2. The diffuser for a turbo pump as specified in claim 1, wherein said opening comprising a groove shape cut on one end of the vane.

3. A method of producing a turbo pump diffuser, comprising:

forming a diffuser with a plurality of diffuser flow paths divided by vanes; and forming on each of said vanes an opening at a specified location in its cord direction for communicating with adjacent diffuser paths by a metal cutting process.

4. The method of producing a turbo pump diffuser as specified in claim 3, wherein said opening comprises a cross-sectional area and further comprising:

determining said cross-sectional area based on a minimum flow rate required of said turbo pump.

5. The method of producing a turbo pump diffuser as specified in claim 3, further comprising forming said opening by machining the vane on one end in a groove shape.

6. The method of producing a turbo pump diffuser as specified in claim 5, further comprising determining the depth of said groove shape by the minimum flow rate required on said turbo pump.

* * * * *